United States Patent [19]

Elliott

[11] 4,274,130

[45] Jun. 16, 1981

[54] COMBINATION FLASHLIGHT AND HIGH INTENSITY LIGHT SOURCE

[76] Inventor: John B. Elliott, 410 Clarence La., Escondido, Calif. 92035

[21] Appl. No.: 69,871

[22] Filed: Aug. 27, 1979

[51] Int. Cl.[3] ..... F21L 5/00; F21L 15/02

[52] U.S. Cl. ..... 362/184; 362/205

[58] Field of Search ..... 362/184, 205

[56] References Cited

U.S. PATENT DOCUMENTS

| | | | |
|---|---|---|---|
| 2,501,548 | 3/1950 | Street | 362/184 |
| 2,520,023 | 8/1950 | Allen | 362/184 |
| 2,739,305 | 3/1956 | Harmon | 362/184 |
| 2,980,889 | 4/1961 | Meissner | 362/184 |
| 4,048,631 | 9/1977 | Flores | 362/184 |

FOREIGN PATENT DOCUMENTS

| | | | |
|---|---|---|---|
| 908688 | 10/1962 | United Kingdom | 362/184 |

*Primary Examiner*—Leland A. Sebastian
*Assistant Examiner*—Irwin Gluck
*Attorney, Agent, or Firm*—Donald R. Nyhagen

[57] ABSTRACT

A combination flashlight and high intensity light source has a case containing a flashlight bulb, a high intensity flash lamp such as a Xenon flashlamp, and circuit means for selectively energizing the bulb and lamp to continuously illuminate the bulb and/or flash the lamp. The preferred embodiment is a hand-held self-contained battery powered flashlight having an elongate tubular case with a rear battery compartment for containing dry cells in end-to-end series relation and a front enlarged head portion containing a common reflector for the light bulb and flash lamp and a circuit board mounting the flash lamp flash circuit.

33 Claims, 10 Drawing Figures

COMBINATION FLASHLIGHT AND HIGH INTENSITY LIGHT SOURCE

BACKGROUND OF THE INVENTION

1. Field:

This invention relates generally to light sources of the class commonly called flashlights. More particularly, the invention relates to a combination flashlight and high intensity light source.

2. Prior Art:

Flashlights so-called are old and well known and are useful for a variety of purposes, such as a light source for illuminating dark areas, a signalling light, a warning light or flare, an emergency locating light, and a defensive or offensive implement or weapon for temporarily blinding an opponent by the flashlight bean. Flashlights are made in a wide range of sizes and shapes but are characterized generally by a case containing a flashlight bulb or the like, a reflector, a transparent window or lens through which light from the bulb is reflected by the reflector, generally in the form of a concentrated beam, and circuit means including a switch and often at least a portion of the case itself for electrically connecting the bulb to a battery. This battery may be contained within or attached to the flashlight case to form a portable selfcontained flashlight structure.

SUMMARY

As will appear from the ensuing description, the present invention may be embodied in most, if not all, of these existing flashlight configurations. The presently preferred embodiment of the invention, however, utilizes the familiar hand-held flashlight configuration including an elongate tubular case with a rear cylindrical portion containing a battery compartment for D size dry cells arranged end to end in electrical series and a front bulbous head portion containing the flashlight bulb and its reflector.

The invention provides a combination flashlight and high intensity light source having, in addition to the conventional flashlight structure described above, a high intensity flash lamp, such as a Xenon flash lamp, an electronic flash circuit for this lamp, and means for selectively energizing the flash circuit and the conventional flashlight bulb from the flashlight battery to flash the flash lamp and/or illuminate the light bulb. Thus, the combination of light of the invention, which is hereafter referred to for simplicity as a flashlight, may be operated as a conventional flashlight or a high intensity light source.

In some cases, it may be desirable to energize the light bulb and flash lamp at the same time. This, of course, will require the battery source of the flashlight to have sufficient capacity to accomplish this.

In the presently preferred embodiment, the high intensity flash lamp is supported directly in front of the flashlight bulb in such a way that the flashlight reflector serves as a common reflector for both the light bulb and the flash lamp for reflecting light from each through the front lens of the flashlight. In one described form of the invention, for example, the flash lamp is supported at its ends on the reflector and extends diametrically across the latter in front of the flashlight bulb. This is the presently preferred lamp supporting arrangement. In another described form, the flash lamp support is a transparent cylinder or sleeve coaxially surrounding the flashlight bulb and supporting the flash lamp in transverse relation to the sleeve axis. A condensing lens may be mounted at the front end of the sleeve in front of the flash lamp. In yet another described flash lamp supporting arrangement, the flash lamp is contained within the front lens of the flashlight.

The electronic flash circuit for the flash lamp of the preferred flashlight embodiment is mounted on a circuit board contained within the front head portion of the flashlight case. This circuit board is disposed in surrounding relation to a flashlight bulb holder at the rear of the reflector and includes circuit elements for connection to the flash lamp terminals and the battery terminals. The flashlight bulb and flash circuit are selectively energized from the batteries through switch means on the flashlight case.

DESCRIPTION OF THE PREFERRED EMBODIMENT

Figure 1:
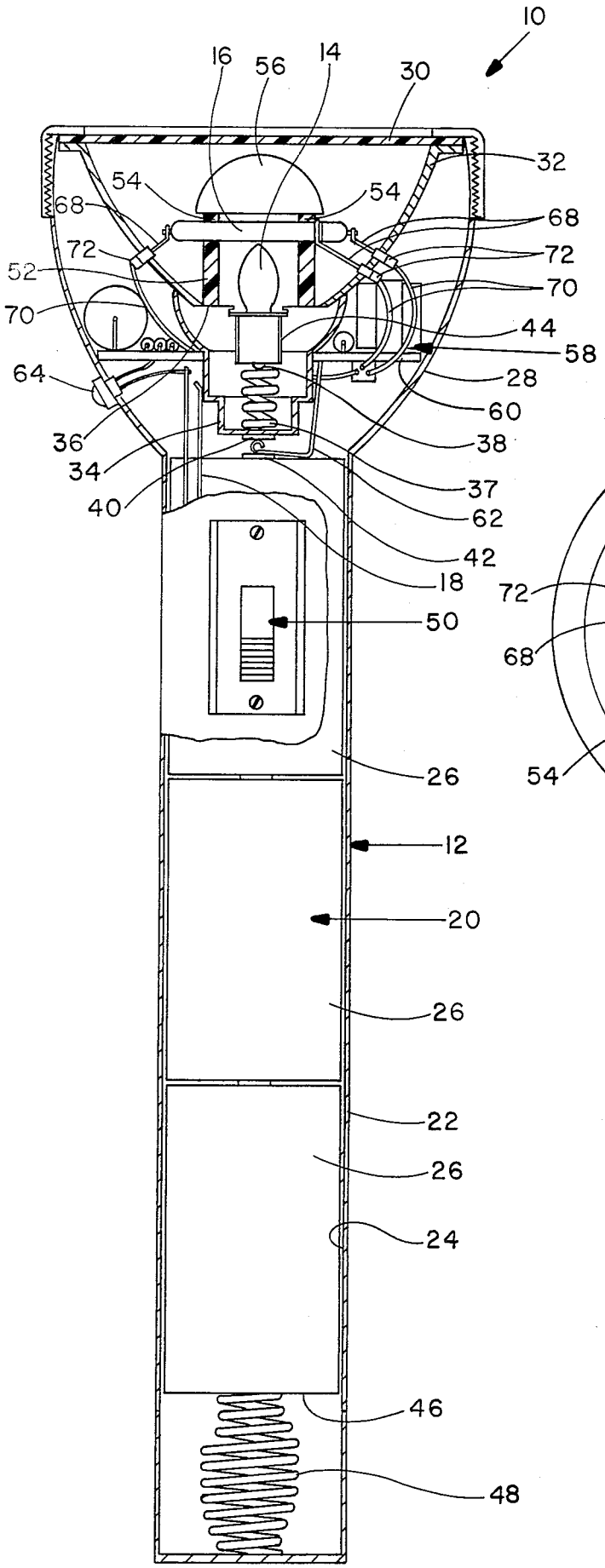
FIG. 1 is a longitudinal section, partly in side elevation, through a flashlight according to the invention.
Figure 2:
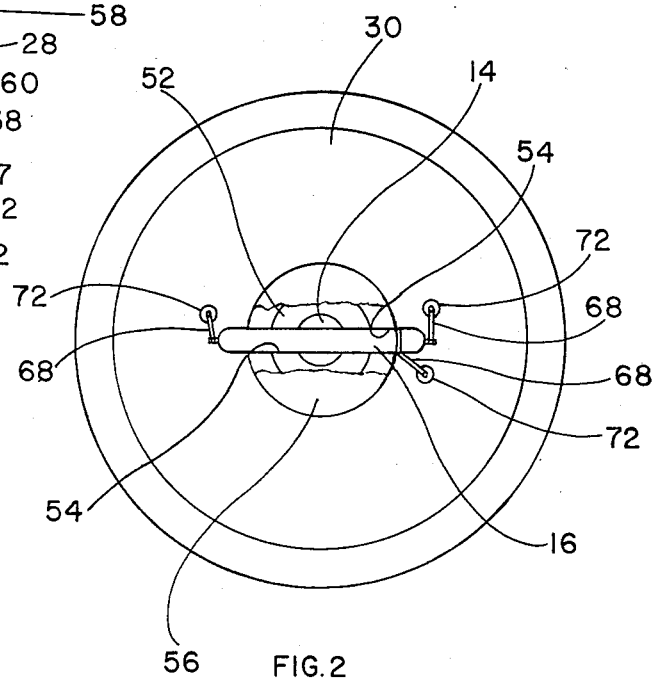
FIG. 2 is a front end view of the flashlight.
Figure 3:
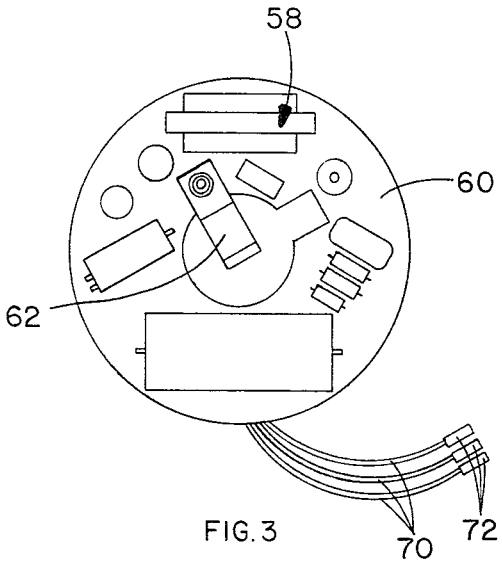
FIG. 3 is a plan view of a circuit board embodied in the flashlight.

Turning first to FIGS. 1–3 of the drawings, the invention provides a flashlight 10 comprising in general terms, a case 12 containing a flashlight bulb 14, a high intensity flash lamp 16 such as a Xenon flash lamp, and circuit means 18 for selectively energizing the bulb 14 and flash lamp 16 from a battery 20 to continuously illuminate the bulb and/or flash the flash lamp. The preferred embodiment illustrated, is a self-contained, hand-held flashlight whose basic structure, excluding the flash lamp 16 and its support and energizing circuitry, is conventional and hence need not be described in elaborate detail.

Suffice it to say that this basic conventional flashlight structure has an elongate tubular case 12. The rear end portion 22 of the case is cylindrical in shape and contains a battery compartment 24 for receiving a number of dry cells 26, typically D size cells, in end-to-end series relation to form the battery 20. The front end portion 28 of the case is enlarged to form a bulbous head having a front opening or aperture spanned by a transparent lens 30. Within the head 28 behind the lens 30 is a generally parabolic reflector 32. The flashlight bulb 14 is situated approximately at the focus of this reflector and is removably mounted within a cup-like holder 34 at the rear end of the reflector 32. The reflector has a rear opening 36 through which the bulb projects.

Within the holder 34 behind the light bulb 14 is a compression spring 37. This spring seats at its front end against a base end contact 38 of the bulb and at its rear end against a contact 40 at the rear end of the holder. In the conventional flashlight, contact 40 seats against the positive terminal 42 of the adjacent front dry cell 26. The base side contact 44 of the bulb 14 is connected to the negative terminal 46 of the rear dry cell 26 in the well-known way through a conducting path which includes the case 12, a compression spring 48 between the latter terminal and the case, and a switch 50 mounted on the case. This conducting path comprises a part of the circuit means 18 referred to above.

According to the preferred practice of this invention, the high intensity flash lamp 16 is mounted in front of the flashlight bulb 14 is such a way that the reflector 32 provides a common reflector for both the bulb and flash lamp. To this end, the flash lamp in the flashlight of FIGS. 1–3 is supported by a transparent sleeve 52 disposed in generally coaxial surrounding relation to the bulb 14. The front end of this sleeve projects forwardly beyond the bulb. The rear end of the sleeve is disposed within and is bonded to the reflector 32 about the rear reflector opening 36.

The flash lamp 16 is a Xenon flash lamp having a small tubular configuration and seats within diametrically opposed slots 54 at the front end of the lamp support sleeve 52 so that the lamp extends transverse to the longitudinal axis of the flashlight. Adhesively bonded or otherwise joined to the front end of the sleeve is a convex lens 56. This lens aids in concentrating the light from both the bulb 14 and flash lamp 16.

Circuit means 18 of the flashlight includes an electronic flash circuit 58 for intermittently energizing or pulsing the flash lamp 16 from the dry cells 26 in such a way as to flash the lamp. This flash circuit may comprise any conventional electronic circuit arrangement and hence need not be described in detail. Suffice it to say that the components of the flash circuit are mounted on an annular circuit board 60 which may be a printed circuit board.

Circuit board 60 is disposed within the head 28 of the flashlight case 12 in surrounding relation to the bulb holder 34, as shown in FIG. 1. The outer perimeter of the board seats rearwardly against the wall of the head 28. The inner perimeter of the board seats forwardly against the enlarged front portion of the bulb holder, whereby the board is positioned in the head jointly by the wall of the head and the holder.

The flash circuit 58 is connected to the positive terminal 42 of the front dry cell 26 by a terminal strip 62 secured to the circuit board 60. This terminal strip extends rearwardly from the board along one side of the bulb holder 34 and then laterally between the cell terminal 42 and the base contact 40 of the bulb holder, as shown in FIG. 1. The flash circuit is connected to the flashlight case 20 through a switch 64 mounted on the wall of the head 28 of the flashlight case 12 and leads 66. Switch 64 is normally open and when closed connects the leads 66 to the case and thence through the case to the negative dry cell terminal 46.

Flash lamp 16 has positive, negative, and trigger terminals 68 at its ends connected to the lamp flash circuit 58. These lamp terminals 68 may be connected to the flash circuit in various ways. In FIGS. 1–3, the flash circuit 58 has leads 70 terminating in sockets 72 which project through and are fixed in holes in the reflector 32 adjacent the ends of the flash lamp 16. These sockets may be soldered to the lamp terminals or receive the ends of the flash lamp terminals 68 with a snug but removable fit which permits removal and replacement of the lamp and yet holds the lamp firmly in position. The sockets insulate the terminals and leads from the reflector.

It will not be understood that the flashlight bulb 14 and high intensity flash lamp 16 may be selectively energized, to continuously illuminate the bulb and flash the lamp, by selective closure of the switches 50, 64. Assuming the dry cells 26 have sufficient capacity, the bulb and lamp may be energized simultaneously by closing both switches which may be desirable in some cases. The reflector 32 provides a common reflector for both the bulb and lamp.

Figure 4:
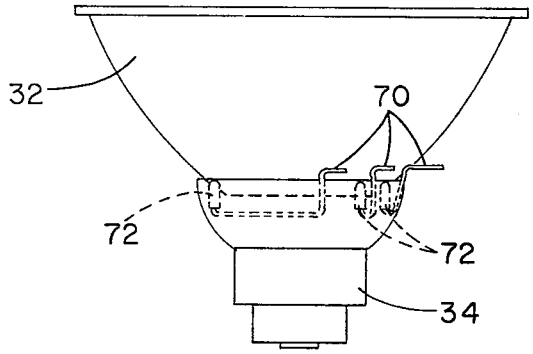
FIG. 4 is a side elevation of a flashlight reflector and flashlight bulb holder embodying a modified flash lamp mounting arrangement.
Figure 5:
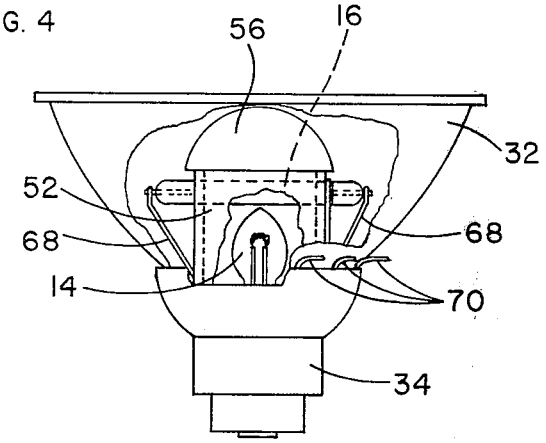
FIG. 5 is a view similar to FIG. 4 partially broken away to show the flash lamp and its support within the reflector.

FIGS. 4 and 5 illustrate an alternative flash lamp mounting arrangement which is similar to that of FIGS. 1–3 except that the flash lamp lead sockets 72 are fixed in holes about the rear opening 36 in the reflector 32. The leads 70 extend outwardly between the reflector and the flashlight bulb holder 34.

Figure 6:
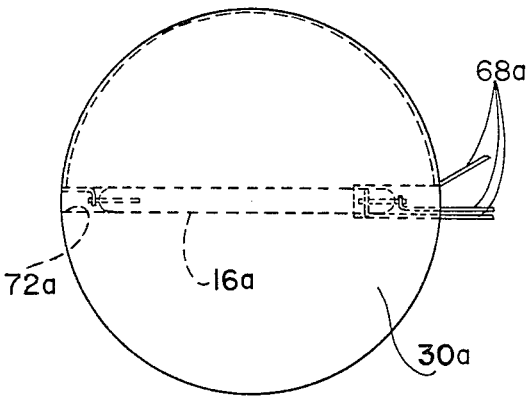
FIG. 6 illustrates a further modified flash lamp mounting arrangement in which the high intensity flash lamp is contained within the front lens of the flashlight.
Figure 7:
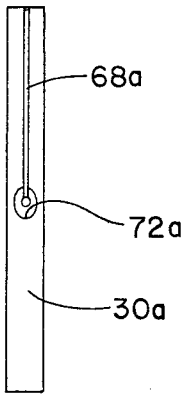
FIG. 7 is a left-hand edge view of the lens in FIG. 6.
Figure 8:
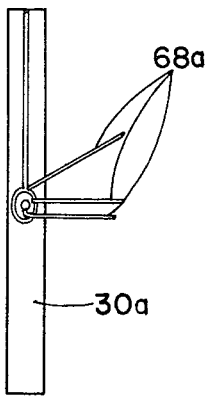
FIG. 8 is a right-hand edge view of the lens.

FIGS. 6, 7 and 8 illustrate yet another flash lamp mounting arrangement, wherein the flash lamp 16*a* is positioned within a diametrical opening 72*a* through the front lens 30*a* of the flashlight. Two of the lamp terminal wires 68*a* extend through the adjacent end of the opening 72*a*. The remaining terminal wire extends through the opposite end of the opening, then about the edge of the lens within a groove in the edge to the first two terminals. The three terminals then will extend to the outside of the reflector 32 and connect to the flash circuit leads 70. It will be understood that the lamp terminals 68*a* will be suitably insulated from the reflector and the case 12.

Figure 9:
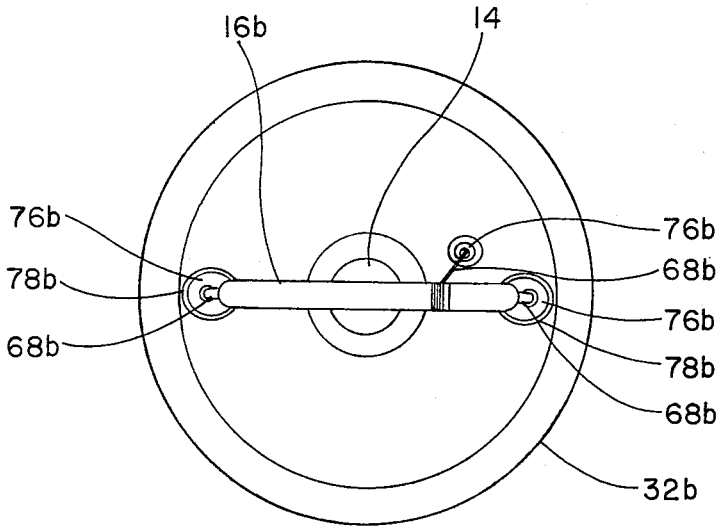
FIG. 9 is a front end view of a flashlight reflector embodying a presently preferred flash lamp mounting arrangement.
Figure 10:
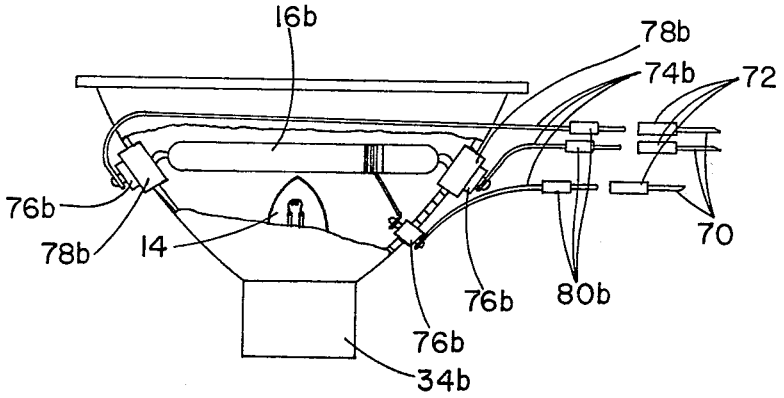
FIG. 10 is a side elevation of the reflector in FIG. 9, partially broken away to illustrate the flash lamp mounting arrangement.

FIGS. 9 and 10 illustrate an alternative and presently preferred flash lamp mounting arrangement. In this arrangement, the flash lamp 16*b* extends diametrically across the reflector 32*b* in front of the flashlight bulb 14. The lamp terminals 68*b* are connected to leads 74*b* disposed externally of the reflector 32*b* through stand-offs 76*b* mounted within holes in the reflector. The two stand-offs which are located at the ends of and receive the anode and cathode terminals of the lamp may be surrounded by rubber grommets 78*b* or the like to provide a shock resistant mounting for the lamp. Leads 72*b* terminate in male couplings 80*b* for insertion into the sockets 72 of the flash circuit leads 70. The lamp terminals 68*b* may be soldered to the leads 74*b*. Alternatively, the stand-offs 72*b* may comprise sockets for releasably receiving the lamp terminals 68*b*. Thus, the flash lamp 14*b* and reflector 32*b* may be arranged for removal and replacement as a unit, or the flash lamp may be arranged for removal and replacement from the reflector.

A readily removable and replaceable flash lamp is desirable to facilitate replacement of a burned out lamp and/or to permit flash lamps of different colors to be easily installed in the flashlight.

The flashlight of this invention may be used for all of the various purposes mentioned earlier in connection with conventional flashlights. However, the present flashlight is superior to the conventional flashlight for such uses because of the high intensity light emitted by the flash lamp 16.

I claim:

1. A flashlight comprising:

a case, a flashlight bulb, and a high intensity flash lamp in said case for transmitting light in the same direction from said case, and circuit means for selectively energizing said light bulb and flash lamp to continuously illuminate said bulb and flash said lamp, whereby said flashlight may be used to selectively illuminate a given area with continuous light from said bulb and illuminate the same area with high intensity light bursts from said lamp.

2. The flashlight of claim 1 including a common reflector for said light bulb and flash lamp.

3. The flashlight of claim 1 wherein said case is an elongate tubular case having a rear cylindrical portion containing a battery compartment and a front head portion containing said light bulb and flash lamp.

4. The flashlight of claim 3 including:

a common reflector in said case head portion for said light bulb and flash lamp.

5. The flashlight of claim 1 wherein:

said flash lamp is situated directly in front of said light bulb, and said flashlight includes a common reflector for said bulb and lamp.

6. The flashlight of claim 5 wherein:

said flash lamp is an elongate lamp extending diametrically across said reflector and supported at its ends in said reflector.

7. The flashlight of claim 1 including:

a transparent sleeve coaxially surrounding said light bulb, and said flash lamp is an elongate lamp extending diametrically across and supported at its ends on the front end of said sleeve.

8. The flashlight of claim 7 including:

a condensing lens at the front end of said sleeve in front of said flash lamp.

9. The flashlight of claim 5 including:

a transparent lens in front of said reflector having a diametrical opening containing said flash lamp.

10. The flashlight of claim 5 wherein:

said circuit means comprises a flash circuit for said flash lamp including a circuit board at the rear of said reflector.

11. The flashlight of claim 10 wherein:

said case is an elongate tubular case having a rear cylindrical portion containing a battery compartment and a front head portion containing said light bulb, flash lamp, reflector, and circuit board.

12. The flashlight of claim 11 wherein:

said flashlight includes a holder for said light bulb at the rear of said reflector, and said circuit board is an annular board concentrically surrounding said holder.

13. For use in a combination flashlight and high intensity light source, the combination comprising:

a reflector, socket means at the base of said reflector for receiving a flashlight bulb, and means for mounting flash lamp such as a Xenon flash lamp in front of said socket means.

14. The combination of claim 13 wherein said flash lamp mounting means comprises a transparent cylinder mounted in said reflector in generally coaxial relation with and projecting forwardly of said socket means and having means at its forward end for receiving said flash lamp.

15. The combination of claim 14 including:

a lens at the front end of said sleeve forwardly of said lamp receiving means.

16. The combination of claim 13 wherein:

said flash lamp includes terminals, and electrical coupling means on said reflector for connection to said lamp terminals.

17. The combination of claim 16 wherein:

said coupling means comprises sockets on the reflector for rewardly receiving said terminals.

18. The combination of claim 16 wherein:

said coupling means provide said flash lamp mounting means.

19. The combination of claim 16 including:

electrical leads disposed externally of said reflector and connected to said coupling means for connecting the latter to a flash lamp flash circuit.

20. The combination of claim 13 wherein:

said flash lamp mounting means comprises a lens at the front end of said reflector, and means on said lens for receiving said flash lamp.

21. The combination of claim 20 wherein:

said flash lamp receiving means comprises an opening in said lens.

22. The combination of claim 21 wherein:

said lens is a disc and said opening extends edgewise through said disc.

23. For use in a combination flashlight and high intensity light source, the combination comprising:

a reflector, a flashlight bulb, a high intensity flash lamp, such as a Xenon flash lamp, means mounting said bulb in said reflector, and means mounting said flash lamp in said reflector.

24. The combination of claim 23 wherein:

said flash lamp is located directly in front of said bulb.

25. The combination of claim 23 wherein:

said flash lamp comprises a tube extending diametrically across said reflector in front of said bulb.

26. The combination of claim 25 wherein:

said flash lamp has terminals, and electrical coupling means mounted on said reflector and connected to said lamp terminals.

27. The combination of claim 26 wherein:

said coupling means provide said flash lamp mounting means.

28. The combination of claim 26 wherein:

said coupling means comprise sockets receiving said flash lamp terminals.

29. The combination of claim 23 wherein:

said flash lamp mounting means comprises a transparent cylinder surrounding said bulb and supporting said flash lamp.

30. The combination of claim 13 including:

a flash lamp flashing circuit mounted on said reflector.

31. The combination of claim 23 including:

a flash lamp flashing circuit mounted on said reflector.

32. For use in a combination flashlight and high intensity light source, the combination comprising:

a transparent sleeve, and a flash lamp such as a Xenon flash lamp mounted at one end of said sleeve.

33. The combination of claim 32 including:

a lens at the front end of said sleeve forwardly of said flash lamp.

* * * * *